US007735494B2

(12) United States Patent
Bollinger et al.

(10) Patent No.: US 7,735,494 B2
(45) Date of Patent: Jun. 15, 2010

(54) TABACCO SMOKING APPARATUS

(75) Inventors: Christopher N. Bollinger, Fayetteville, NY (US); Kenneth B. Digney-Peer, Fayetteville, NY (US)

(73) Assignee: XeroSmoke, LLC, Fayetteville, NY (US)

( * ) Notice: Subject to any disclaimer, the term of this patent is extended or adjusted under 35 U.S.C. 154(b) by 693 days.

(21) Appl. No.: 11/367,109

(22) Filed: Mar. 3, 2006

(65) Prior Publication Data

US 2007/0204868 A1 Sep. 6, 2007

(51) Int. Cl.
*A24F 13/16* (2006.01)

(52) U.S. Cl. ..... 131/349; 131/359; 131/273

(58) Field of Classification Search ..... 131/394, 131/359, 273, 335, 365, 330, 349
See application file for complete search history.

(56) References Cited

U.S. PATENT DOCUMENTS

| | | | |
|---|---|---|---|
| 3,612,068 | A | 10/1971 | Higbee |
| 3,685,523 | A | 8/1972 | Labbe at al. |
| 3,854,384 | A | 12/1974 | Naylor at al. |
| 3,882,877 | A | 5/1975 | Brackmann at al. |
| 3,955,585 | A | 5/1976 | Fox |
| 4,014,353 | A | 3/1977 | Kahler |
| 4,029,109 | A | 6/1977 | Kahler |
| 4,041,960 | A | 8/1977 | Kahler |
| 4,044,781 | A | 8/1977 | Heggestuen |
| 4,052,179 | A | 10/1977 | Kirk |
| 4,066,088 | A | 1/1978 | Ensor |
| 4,068,672 | A | 1/1978 | Guerra |
| 4,083,374 | A | 4/1978 | Jacobsen |
| 4,134,410 | A | 1/1979 | Kahler |
| 4,164,230 | A | 8/1979 | Pearlman |
| 4,172,460 | A | 10/1979 | Robertson |
| 4,190,062 | A | 2/1980 | Paden |
| 4,193,411 | A | 3/1980 | Faris et al. |
| 4,198,992 | A | 4/1980 | Smith |
| 4,200,114 | A | 4/1980 | Waite |
| 4,203,455 | A | 5/1980 | Byrd, Jr. |
| 4,211,244 | A | 7/1980 | Williams |
| 4,216,786 | A | 8/1980 | Wright |
| 4,219,032 | A | 8/1980 | Tabatznik et al. |
| 4,223,687 | A | 9/1980 | Sandeen |
| 4,243,058 | A | 1/1981 | Gershbein |
| 4,244,383 | A | 1/1981 | Kahler |
| 4,259,971 | A | 4/1981 | Orter |
| 4,276,892 | A | 7/1981 | Iaquinta |
| 4,278,099 | A | 7/1981 | Jacobsen |
| 4,281,672 | A | 8/1981 | Caraway |
| 4,369,798 | A | 1/1983 | Jackson |
| 4,585,014 | A | 4/1986 | Fry |

(Continued)

FOREIGN PATENT DOCUMENTS

| | | |
|---|---|---|
| CA | 1057924 | 7/1979 |

(Continued)

*Primary Examiner*—Carlos Lopez
(74) *Attorney, Agent, or Firm*—Marjama Muldoon Blasiak & Sullivan LLP

(57) ABSTRACT

The invention provides a tobacco smoking apparatus that enables a person to smoke, namely inhale and exhale smoke and other combustion products from burning tobacco, while isolating and protecting others from a substantial portion of the combustion products, including smoke, smoker's exhale and odor, that are produced from smoking tobacco.

72 Claims, 8 Drawing Sheets

U.S. PATENT DOCUMENTS 4,637,407 A 1/1987 Bonanno et al.
4,638,819 A 1/1987 Ikeda et al.
4,685,477 A 8/1987 Valdez
4,732,167 A 3/1988 Nagano et al.
4,774,970 A 10/1988 Bell
4,788,988 A 12/1988 Titus
4,790,332 A 12/1988 Wallace
4,807,646 A 2/1989 Sahar et al.
4,848,374 A 7/1989 Chard et al.
4,881,554 A 11/1989 Obasogie
4,898,191 A 2/1990 Johnson et al.
4,899,766 A 2/1990 Ross, Jr.
4,953,572 A 9/1990 Rose et al.
4,961,438 A 10/1990 Korte
4,993,435 A 2/1991 McCann
D315,617 S 3/1991 Boutte
5,038,804 A 8/1991 Chao et al.
5,048,545 A 9/1991 Takagi et al.
5,069,230 A 12/1991 Green
5,088,508 A 2/1992 Duncan
5,105,835 A 4/1992 Drewett et al.
5,160,518 A 11/1992 Vega, Jr.
5,240,015 A 8/1993 Rosen et al.
5,353,814 A 10/1994 Martin
5,388,595 A 2/1995 Shafer
5,396,907 A 3/1995 Rojas Henao et al.
5,402,803 A 4/1995 Takagi et al.
5,423,335 A 6/1995 Evans
5,469,870 A 11/1995 Meador
5,472,001 A 12/1995 Nicholson
5,495,859 A 3/1996 Bowen et al.
5,497,791 A 3/1996 Bowen et al.
5,501,234 A 3/1996 Hyre
5,529,078 A 6/1996 Rehder et al.
5,598,853 A 2/1997 Hyre
5,638,833 A 6/1997 Bowen et al.
5,738,118 A 4/1998 Ikoma et al.
5,752,527 A 5/1998 Bowen et al.
D399,600 S 10/1998 Bowen et al.
5,829,450 A 11/1998 Hicaro, Jr. et al.
5,908,479 A 6/1999 Wampole
5,976,008 A 11/1999 Rubin
5,996,589 A 12/1999 St. Charles
6,006,757 A 12/1999 Lichtenberg
6,012,459 A 1/2000 Keefe et al.
6,014,974 A 1/2000 Possamai et al.
D424,236 S 5/2000 Reed
6,073,633 A 6/2000 Herman
6,089,236 A 7/2000 Alexsen
6,116,247 A 9/2000 Banyasz et al.
6,156,530 A 12/2000 Rangnby et al.
6,158,530 A 12/2000 Bowen et al.
6,182,669 B1 2/2001 van der Elst et al.
6,273,094 B1 8/2001 Potter
6,311,694 B1 11/2001 Nichols et al.
6,318,376 B1 11/2001 Cheng et al.
6,345,625 B1 2/2002 Chew et al.
6,349,728 B1 2/2002 Pham
6,354,301 B2 3/2002 McCoy
6,358,871 B1 3/2002 Sircar
6,431,176 B1 * 8/2002 Rice ..... 131/175
6,523,463 B1 2/2003 Hogle
6,748,955 B2 6/2004 Snaidr et al.
6,780,213 B2 8/2004 Chang et al.
6,794,322 B2 9/2004 Sircar
6,839,305 B2 1/2005 Perlman et al.
6,920,855 B2 7/2005 Takenaka et al.
7,082,825 B2 8/2006 Aoshima et al.
2002/0083952 A1 7/2002 Braun
2002/0114223 A1 8/2002 Perlman et al.
2004/0261804 A1 12/2004 Mitchell
2005/0217683 A1 10/2005 Kollasch et al.
2006/0027242 A1 2/2006 Edwards
2006/0107965 A1 5/2006 Marshall
2007/0089757 A1 4/2007 Bryman
2007/0204868 A1 9/2007 Bollinger et al.
2007/0215164 A1 9/2007 Mehio
2008/0053465 A1 3/2008 Tarora et al.
2008/0060664 A1 3/2008 Richards

FOREIGN PATENT DOCUMENTS

WO WO-9009741 9/1990

* cited by examiner

TABACCO SMOKING APPARATUS

FIELD OF THE INVENTION

This invention relates generally to a tobacco smoking apparatus, and specifically to a tobacco smoking apparatus that isolates a substantial portion of the combustion products including smoke and odor, that are produced from the combustion of tobacco and later exhaled by a tobacco smoker, for the purpose of protecting others from the ill health effects and nuisance of the combustion products, the smoke, the smokers exhale and the odor.

BACKGROUND OF THE INVENTION

Smoke that is produced from a burning cigarette and that is exposed to people that are not inhaling from the burning cigarette, is referred to as second hand smoke. A smokers exhale is that which is exhaled by a smoker of a burning cigarette. The second hand smoke, a smoker's exhale and associated odors are included within a set of the combustion products that are produced from the combustion of tobacco. Second hand smoke, the smoker's exhale and the associated odors and the other combustion products are generally believed to create negative health effects upon, and are generally considered a nuisance to, those people exposed to it.

SUMMARY OF THE INVENTION

The invention provides a tobacco smoking apparatus that enables a person to smoke, namely inhale and exhale smoke and other combustion products from burning tobacco, while isolating and protecting others from a substantial portion of the combustion products, including smoke, smoker's exhale and associated odors that are produced directly or indirectly from the burning tobacco.

BRIEF DESCRIPTION OF THE DRAWINGS

The objects and features of the invention can be better understood with reference to the claims and drawings described below. The drawings are not necessarily drawn to scale, and the emphasis is instead generally being placed upon illustrating the principles of the invention. Within the drawings, like reference numbers are used to indicate like parts throughout the various views. Differences between like parts may cause those parts to be indicated by different reference numbers. Unlike parts are indicated by different reference numbers.

For a further understanding of these and objects of the invention, reference will be made to the following detailed description of the invention which is to be read in connection with the accompanying drawing, wherein.

DETAILED DESCRIPTION OF THE INVENTION

Figure 1:
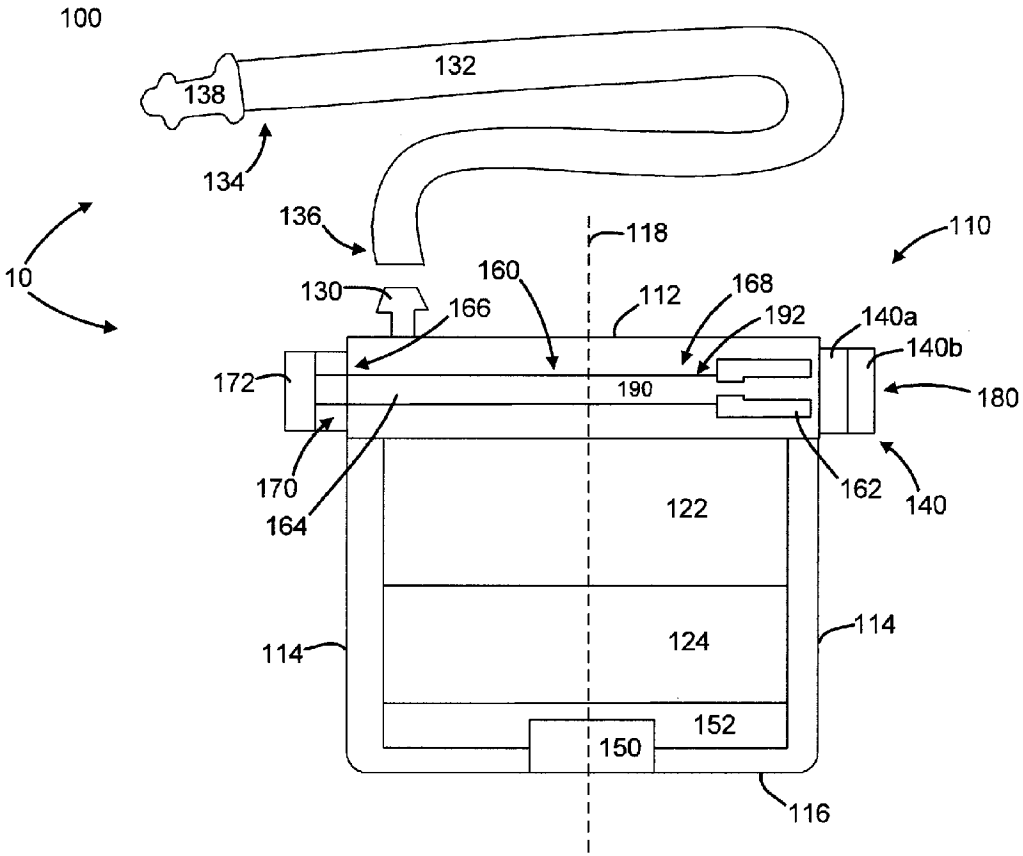
FIG. 1 illustrates a side cross-sectional view of an embodiment of a tobacco smoking apparatus that is configured for smoking cigarette tobacco.

FIG. 1 illustrates a side cross-sectional view of an embodiment 100 of a tobacco smoking apparatus 10 that is configured for smoking cigarette tobacco. A cigarette loading port 180, also referred to as a tobacco loading port 180, is shown in a closed position. As shown, an enclosure 110, also referred to as a canister 110 or containment 110, includes an upper surface 112, a side surface 114 and a lower surface 116. The enclosure 110 has a generally cylindrical shape. The upper surface 112 and lower surface 116 are substantially circular and flat. The side surface 114 is substantially curved. In some embodiments, the upper surface 114 and the lower surface 116 are dimensioned to have a diameter of approximately 4 inches, and the side surface 114 is dimensioned to have a height (perpendicular to its curve) of approximately 4.75 inches.

The enclosure 110 includes an inhale/exhale port 130 that has an exterior portion that is also referred to as a nipple 130 and which is configured to attach to an inhale/exhale conduit 132. The inhale/exhale conduit 132 includes a proximal end 134 having an attached mouthpiece 138 and a distal end 136 which is configured to attach to and detach from the nipple portion of the inhale/exhale port 130 of the enclosure 110. Preferably, the nipple 130 is made of aluminum, the inhale/exhale conduit 132 is made of rubber and the mouthpiece 138 is made of nickel.

The enclosure 110 also includes an air input port 140 and a gas output port 150. The air input port 140 is configured to input atmospheric gases, collectively referred to as air, that reside outside of the enclosure 110. The air input port 140 is configured to input air when a detected pressure of internal gases residing inside of the enclosure, also referred to as an internal gas pressure, is substantially less than a detected pressure of the air residing outside of the enclosure, also referred to as atmospheric pressure. Preferably, the input port is implemented as a pressure sensitive one way valve that actuates (opens) upon less than 0.5 pounds per square inch (PSI).

The gas output port 150 is configured to output the internal gases residing inside of the enclosure 110. The gas output port 150 is configured to output the internal gases, including smoke and other particulates, when the internal gas pressure of those internal gases is substantially greater than the atmospheric pressure of the air residing outside of the enclosure 110. The gas output port 150 resides with a gas output cavity 152 located at a bottom portion of the enclosure 110. Preferably, the gas output port 150 is implemented as a pressure sensitive one way valve that actuates (opens) upon a pressure difference of less than 0.5 pounds per square inch.

An aluminum spacer (not shown) provides support from gravity to the filters 122, 124 located above it and separates the gas output cavity 152 from the remainder of the enclosure 110. Optionally, a layer of white filter media is disposed between the charcoal filter 124 and the gas output cavity 152. The white filter paper is made from tightly woven cotton or cotton like material that functions as a dust barrier between the granulated charcoal (charcoal dust) generated within the combustion cavity 174 and the gas output valve 150 disposed within the gas output cavity 152.

In some embodiments, the portion of the enclosure 110 that surrounds the combustion cavity 174 is made from stainless steel. In some embodiments, the height of the side surface 114 of the combustion cavity is approximately 1.25 inches. Optionally, a remaining portion of the enclosure 110, not surrounding the combustion cavity 174, can be made from other types of material, such as an acrylic.

The enclosure 110 also includes a cigarette loading apparatus 160, including a cigarette loading port 180, that assists with the loading (transfer) of pre-combusted tobacco in the form of a cigarette, into the enclosure 110 and that assists with the output (transfer) of post-combusted tobacco from the enclosure 110. In this embodiment, the cigarette loading apparatus 160 is configured to assist the loading of a pre-combusted cigarette from outside of the enclosure 110 to inside of the enclosure 110 via a sliding cigarette attaching device 162, also referred to as a cigarette holder 162. Preferably, the cigarette holder 162 is made from stainless steel.

The cigarette holder 162 is shaped like a cup without an attached handle. The cup has an open side (mouth) and an opposing passageway side (base). The open side provides access to a cavity that resides within the boundaries of the cup. The cavity is dimensioned to receive and engage (attach) to one end of a cigarette via a "snug fit" type of engagement. A user of the device 10 can open the cigarette loading port 180 and push a cigarette into the cigarette holder 162 and/or pull a cigarette out of the cigarette holder 162 while applying a small amount (less than a pound) of force.

The passageway side (base) provides a passage 190 for combustion products to flow into a hollow rod 164 and towards the inhale/exhale port 130. The rod, which is hollow, also has a breathing hole 192 (See FIG. 5A) along its top side so that the flow of tobacco combustion products can exit the rod 164 and exit the enclosure 110 via the inhale/exhale port 130. In other embodiments, not shown, the cigarette holder 162 is formed by the end of a continuous tube that is dimensioned to accommodate a cigarette.

The cigarette loading apparatus 160 also includes a rod 164 having a proximal end 166 and a distal end 168. The rod 164 is configured to slide through a rod port 170. The distal end 168 of the rod 164 is configured to attach to the base of the cup of the cigarette holder 162 and to reside within the enclosure 110. The proximal end 166 of the rod 164 is configured to reside outside of the enclosure 110. Optionally, and as shown, the rod 164 includes a knob 172, also referred to as an end cap 172, having a knurled outer surface (not shown). The knob 172 is configured to enable a user of the device 10 to grasp and pull the rod 164 substantially out of, or push the rod 164 substantially into, the enclosure 110.

The cigarette loading apparatus 160 also includes a cigarette loading port 180 that resides at a location opposite to the rod port 170. The cigarette loading port 180 is a circular shaped opening that is dimensioned to allow for the passage of a cigarette of standard size. The cigarette of standard size, also referred to herein as a cigarette, has a forward end and a back end. The cigarette is configured so that tobacco combustion occurs at its forward end when the cigarette is lit (lighted) and configured for a person (user) to inhale substances produced from the tobacco combustion from the back end of the cigarette.

When the rod 164 is pushed substantially into the enclosure, the cup shaped cigarette holder 162 that is attached to the distal end 168 of the rod is positioned proximate to the cigarette loading port 180. As it 162 is attached to the rod 164, the cup shaped cigarette holder 162 is oriented so that its opening (mouth) faces the cigarette loading port 180.

The cigarette loading apparatus 160 resides within a tobacco combustion cavity 174 that occupies a top portion of the enclosure 110. The device 10 is configured so that tobacco combustion occurs and tobacco combustion products are produced within the tobacco combustion cavity 174. A first portion of the tobacco combustion products are output from the enclosure 110 via the inhale/exhale port 130 and the gas output port 150. A second portion of the tobacco combustion products are collected by and contained within the enclosure 110 via the one or more filters 122, 124. Preferably, the cigarette holder 162 and the rod 164 are made from stainless steel.

The upper surface 112 and the side surface 114 of the top portion of the enclosure 110 that surrounds the tobacco combustion cavity 174 is preferably made of stainless steel. The side surface 114 below that enclosing the combustion cavity 174 and the bottom surface 116 are preferably made of acrylic material.

Figure 2:
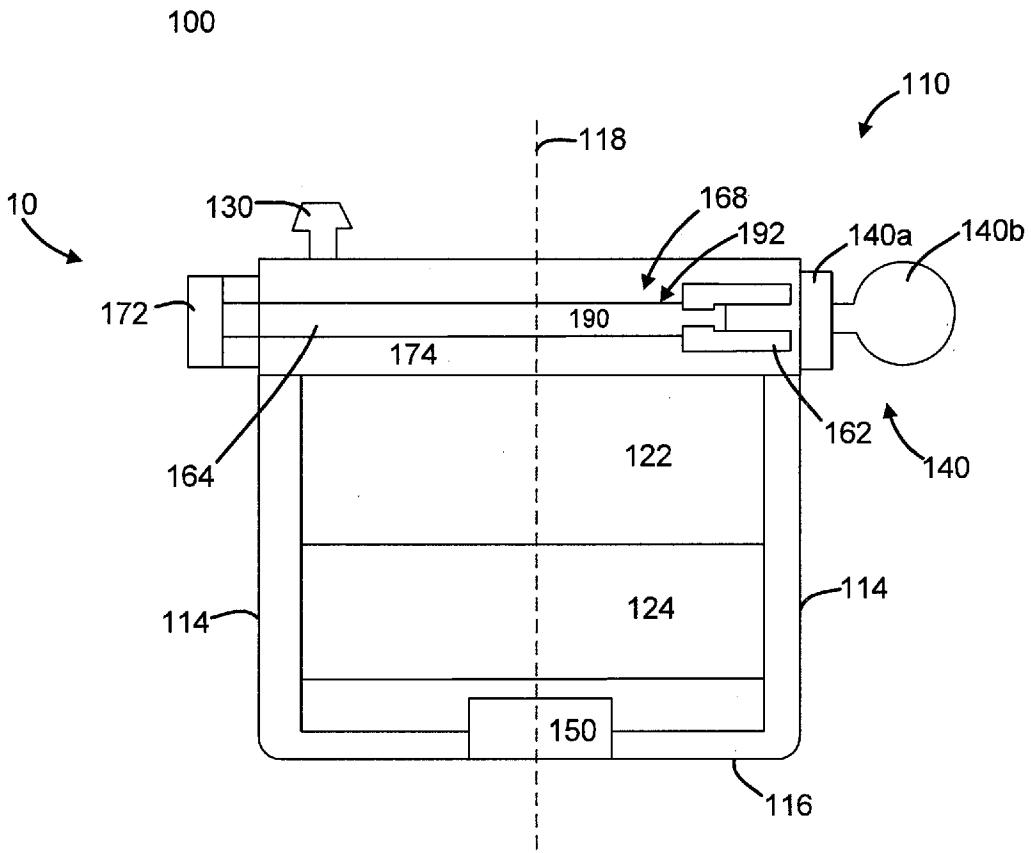
FIG. 2 illustrates a side cross-sectional view of an embodiment the tobacco smoking apparatus of FIG. 1 with the cigarette loading port in an open position.

FIG. 2 illustrates a side cross-sectional view of an embodiment a tobacco smoking apparatus 10 with the cigarette loading port 180 in an open position. When the cigarette loading port 180 is in the open position (See FIG. 2) and when the cigarette holder 162 is located proximate to the cigarette loading port 180, a user can push the back end of a cigarette through the cigarette loading port 180, through the opening of and into the cup shaped cigarette holder 162 in order for it 162 to engage and attach to the back end of the cigarette.

In a typical use scenario, the user of the device 10 inserts the back end of a cigarette into the cigarette holder 162 as described above (See FIG. 3). In this circumstance, the back end of the cigarette is disposed inside of the enclosure 110 while a remaining portion of the cigarette, including its front end, is disposed substantially outside of, and protrudes from, the enclosure 110.

Figure 3:
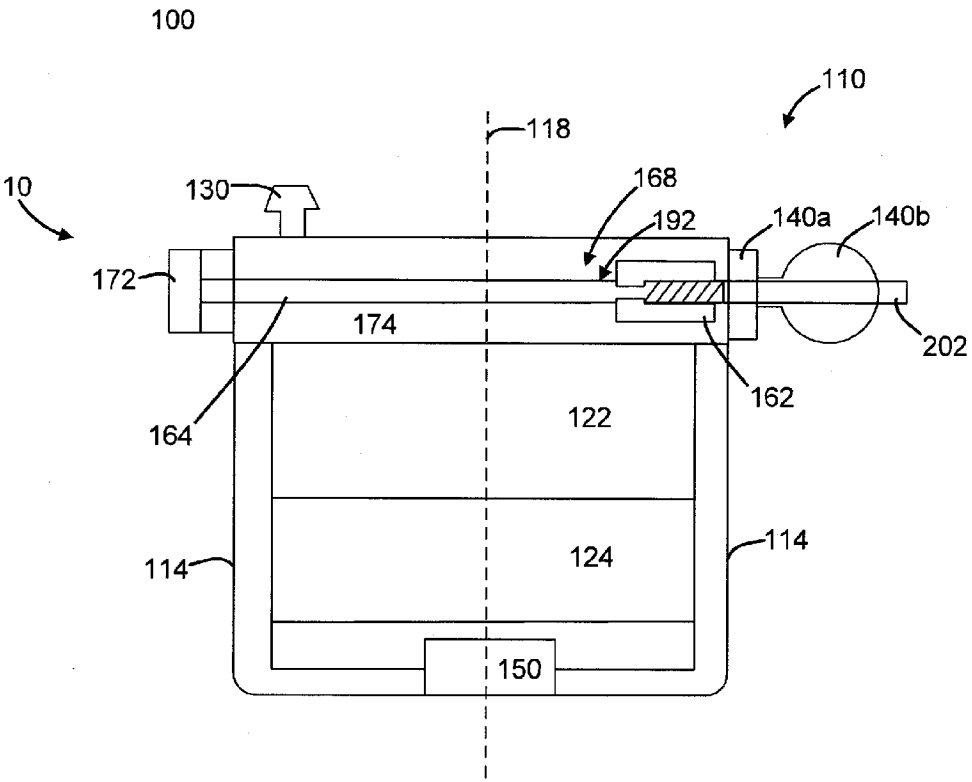
FIG. 3 illustrates a side cross-sectional view of an embodiment the tobacco smoking apparatus of FIGS. 1-2 with an unlit cigarette being loaded through the cigarette loading port.

FIG. 3 illustrates a side cross-sectional view of an embodiment of a tobacco smoking apparatus with an unlit cigarette 202 being loaded through the cigarette loading port in an open position. Continuing the use scenario described above, the user pulls the rod 164 substantially out of the enclosure to transfer the entire cigarette 202 into the enclosure (See FIG. 4). When the rod 164 is pulled substantially from the enclosure, the cup shaped cigarette holder 162 that is attached to the distal end 168 of the rod is pulled sufficiently away from the cigarette loading port 180 so that the entire attached cigarette 202 is pulled into and entirely enclosed within the enclosure 110. In this position, the back end of the cigarette 202 is proximate to the inhale/exhale port 130 and the front end of the cigarette 202 is proximate to the cigarette loading port 180.

The user next lights (places in physical contact with a) the cigarette 202 as it is preferably disposed within and proximate to the cigarette loading port 180. Optionally, the cigarette 202 can be lit when it is protruding from the cigarette loading port 180, before it is pulled into the enclosure 110. The cigarette 202 is now lit (not shown).

Next, the air input port 140 is closed by pivoting the outside (pivotable) portion **140*b* of the air input port 140 to the enclosure sealing position. When in the enclosure sealing position, the air input port 140 is operable to respond to the pressure of the internal gases within the enclosure 110**.

Figure 4:
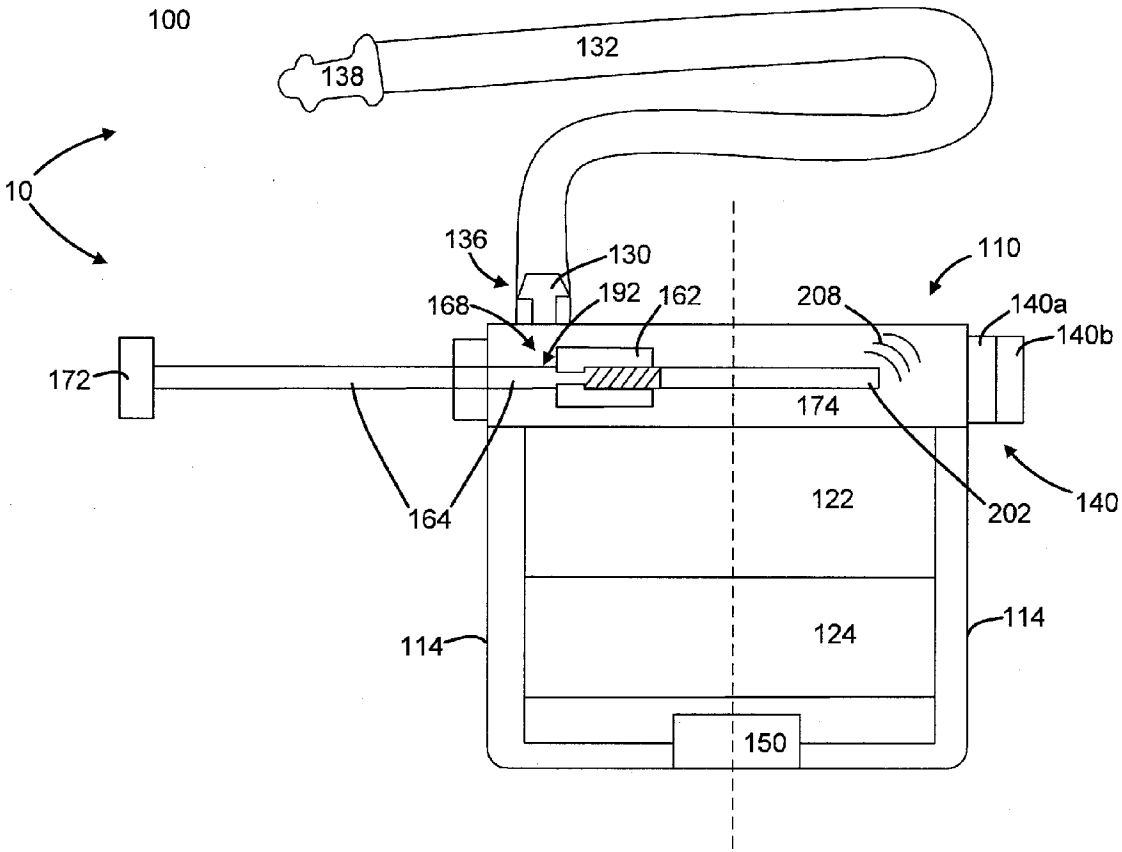
FIG. 4 illustrates a side cross-sectional view of the embodiment a tobacco smoking apparatus of FIGS. 1-3 with a lit cigarette being fully loaded into the cigarette loading port.

FIG. 4 illustrates a side cross-sectional view of the embodiment of the tobacco smoking apparatus 10 with a lit cigarette 202 being fully loaded within the enclosure 110 and the cigarette loading port 180 being in a closed position. Tobacco combustion occurring at the front end of the lit cigarette 202 produces combustion products 208 which fill the tobacco combustion cavity 174. As shown, the distal end 136 of the inhale/exhale conduit 132 is attached to and substantially surrounds the nipple of the inhale/exhale port 130.

Continuing the use scenario described above, the user (not shown) next engages the mouthpiece 134 of the inhale/exhale conduit 132 via his/her mouth and inhales through the inhale/exhale conduit 132. Inhaling through the inhale/exhale conduit 132 causes a reduction in the internal gas pressure of the enclosure 110 and causes substances produced from the tobacco combustion to exit the back end of the cigarette 202 and the enclosure 110 and to travel through the inhale/exhale port 130 and the inhale/exhale conduit 132 to the user.

The reduction of internal gas pressure causes the air input port 140 to open and to input air from the atmosphere into the enclosure 110. The air that is input from the atmosphere mixes into forms a portion of the internal gases residing within the enclosure 110.

Next, the user exhales through the inhale/exhale conduit 132. Exhaling through the inhale/exhale conduit 132 causes an increase to the internal gas pressure of the enclosure 110 and causes substances 208 produced from the tobacco combustion to cease traveling from the enclosure 110 and through the inhale/exhale conduit 132 to the user. The increase of internal gas pressure within the enclosure 110 causes the gas output port 150 to open and to allow the internal gases from the enclosure 110 to output (discharge) from the enclosure 110.

The enclosure 110 is configured so that any flow of the internal gases from the combustion cavity 174 to the gas output port 150 travels through the one or more filters 122, 124. The enclosure 110 is configured so that there is no path within the enclosure 110 where internal gases from the combustion cavity 174 can flow to the gas output port 150 without traveling through the one or more filters 122, 124. Hence, internal gases residing within the enclosure 110 travel through the one or more filters 122, 124 before being output through the gas output port 150 and into the atmosphere.

In this embodiment, the internal gases pass through the HEPA filter 122 and the carbon filter 124. The HEPA filter 122 and the carbon filter 124 are disposed in series along a longitudinal axis 118 of the enclosure 110. A HEPA (high efficiency particulate arrestant) filter 122, is configured to filter small particles mixed with the internal gasses. Typically a HEPA filter can filter particles that are less than a micron in diameter. The carbon filter 124 is configured to reduce unpleasant odors and filter particles that are typically larger than those particles that are filtered by a HEPA filter 122, from the internal gases.

The device 10 substantially filters and removes particles and unpleasant odors included within second hand smoke, produced from tobacco combustion, before discharge into the atmosphere. This second hand smoke (particles and unpleasant odors) is believed to cause ill health effects among those people exposed to it. Also, this second hand smoke is generally considered a nuisance. As a result, people within proximity of the user (smoker) of the device 10 are substantially less affected by the ill health affects and nuisance of second hand smoke.

Figure 5A:
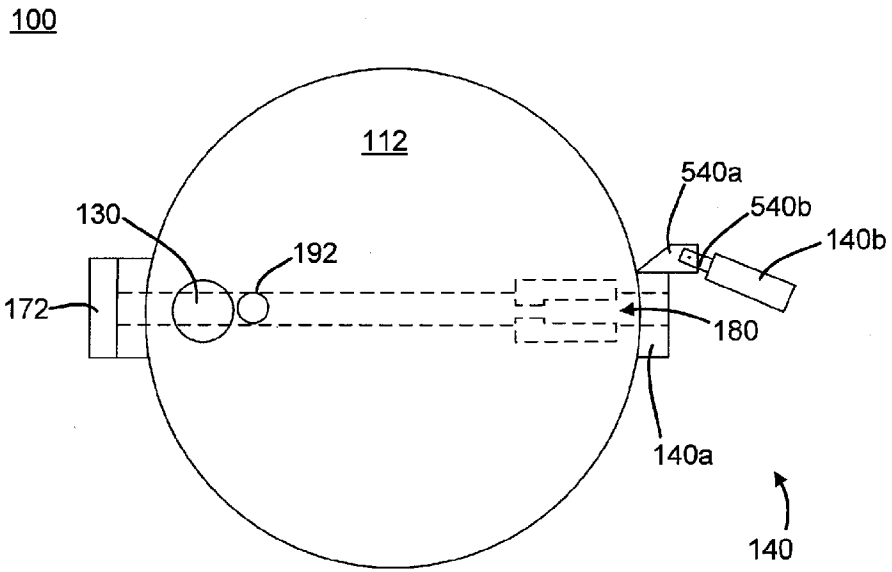
FIG. 5A illustrates a view of the top surface of the tobacco smoking apparatus of FIGS. 1-4.

FIG. 5A illustrates a view of the top surface 112 of the tobacco smoking apparatus 10 of FIGS. 1-4. As shown, the cigarette loading 180 port is in an open position. A first hinge piece 540*a* is attached to the base portion 140*a* of the air input port 140. A second hinge piece 540*b* is attached to the outside (pivotable) portion 140*b* of the air input port 140.

A cross-sectioned outline of the cigarette loading apparatus 160 that is located below and obstructed from view by the top surface 112, is shown as being marked with dashed lines. As shown, the breather hole 192 is located proximate to the inhale/exhale port 130.

As shown, outside (pivotable) portion 140*b* of the air input port 140 is pivoted away from the base portion 140*a* of the air input port 140 and is in an enclosure unsealing position. In this enclosure unsealing position, the cigarette loading port 180 is exposed and available for use. When the base portion 140*a* and the outside (pivotable) portion 140*b* of the air input port 140 are closed together and abutting each other (Shown in FIGS. 1, 4 and 5B), the air input port 140 is in an enclosure sealing position. In the enclosure sealing position, the cigarette loading port 180 is not accessible to the user and is not available for use.

Figure 5B:
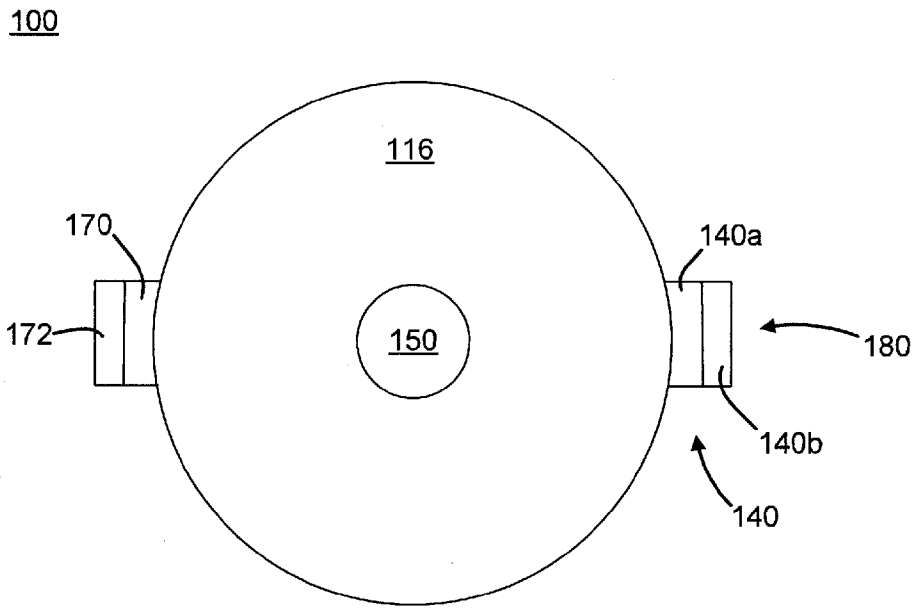
FIG. 5B illustrates a view of the bottom surface of the tobacco smoking apparatus of FIGS. 1-4.

FIG. 5B illustrates a view of the bottom surface 116 of the tobacco smoking apparatus 10 of FIGS. 1-4. As shown, the cigarette loading 180 port is in a closed position. As shown, outside (pivotable) portion 140*b* of the air input port 140 is pivoted towards and abutting the base portion 140*a* of the air input port 140. In this enclosure sealing position, the cigarette loading port 180 is not exposed (obscured) and not available for use.

Figure 6:
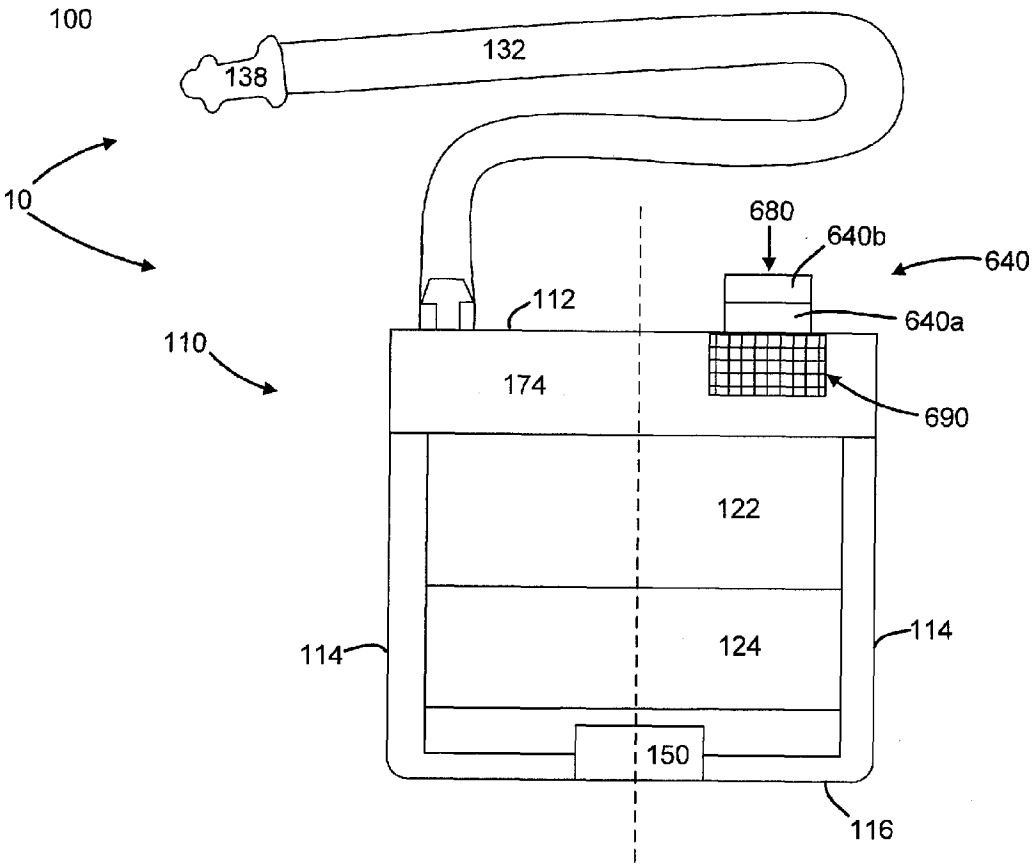
FIG. 6 illustrates a side cross-sectional view of an embodiment of a tobacco smoking apparatus that is configured for smoking loose tobacco.

FIG. 6 illustrates a side cross-sectional view of an embodiment 600 of a tobacco smoking apparatus 10 that is configured for smoking loose tobacco. This embodiment 600 of the invention enables a user to smoke loose tobacco like the loose tobacco that is smoked within a tobacco pipe.

This embodiment 600 is structured substantially like the cigarette smoking embodiment 100 of FIGS. 1-5B with the exception that the cigarette loading apparatus 160 (including the cigarette loading port 180) is eliminated from the enclosure 110 and that the air input port 140 of the first embodiment 100 (See FIG. 1) is relocated from the side surface 114 to the top surface 112 of the enclosure 110.

As relocated onto the top surface 112, the air input port 640 of this embodiment 600 (Now identified using reference number 640 instead of 140) is structured and functions the same as the air input port 140 located on the side surface 114 of the first cigarette smoking embodiment 100 (See FIG. 5A). Like the air input port 140, the air input port 640 includes a base portion 640*a* and the outside (pivotable) portion 640*b* and is hinged in the same manner (not shown in FIG. 6) as described in FIG. 5A. Unlike the air input port 140, the outside (pivotable) portion 640*b* of air input port 640 pivots and opens upwards, instead of pivoting and opening sideways as shown for FIGS. 2 and 5A.

Also like the cigarette input port 180 of the first embodiment 100, tobacco is entered into the enclosure 110 via a loose tobacco input port 680, also referred to as a tobacco loading port 680. Instead of transferring a cigarette into the enclosure 110, loose tobacco is transferred (dropped and/or pushed) into the tobacco input port 680.

Unlike the first cigarette smoking embodiment 100, a loose tobacco bowl 690, constructed from a fine meshed metal screen, is disposed below the tobacco input port 680 and stores any loose tobacco transferred into the enclosure 110 via the loose tobacco input port 680. In a typical use scenario, the user lights the loose tobacco stored within the loose tobacco bowl 680, typically using a flame extending through the tobacco input port 680. The loose tobacco bowl 680 separates combusting (burning) loose tobacco that is stored within it 680 from any remaining portion of the tobacco combustion cavity 174 and the enclosure 110.

Combustion products that are sufficiently small to pass through the fine mesh metal screen can enter any remaining portion of the combustion cavity 174 and exit the enclosure 110 via the inhale/exhale conduit 132 or via the gas output value 150.

Preferably, various contact points and edges located between separate components of the device 10 are sealed using a rubber material. For example, the circular perimeter of the air input valve 140, of the gas output valve 150, of the hollow rod 164, of the stainless steel top portion of the enclosure 110 and of the nipple 130 can be sealed using a rubber "o ring" type of seal. Also, components can be threaded to mechanically attach to each other and washers can be used to interoperate with the threaded portions of the threaded components, where appropriate.

Figure 7:
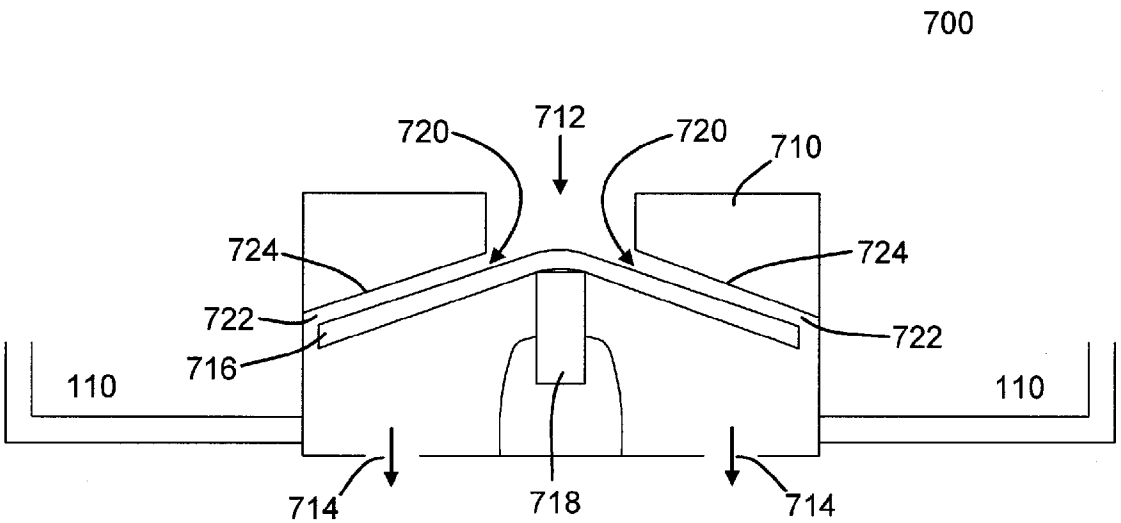
FIG. 7 illustrates a side cross-sectional view of a flapper valve embodiment of a gas output port.

FIG. 7 illustrates a side and a top cross-sectional view of an embodiment 700 of a flapper valve that is implemented a gas output port 150. As shown, a flapper valve housing 710 is oriented so that internal gases from the enclosure 110 can flow through an inlet port 712 and make physical contact with a flapper 716. The flapper 716 is bowed in the upwards direction and towards the inlet port 712 and towards the internal gases residing within the enclosure 110. A center portion of the flapper is in physical contact with and physically held in place by a flapper support 718 in a position adjacent to the inlet port 712.

The flapper 716 is manufactured to have a flat and circular shape when it is not being influenced by outside forces. Outside forces supplied by the flapper support 718 and by an inner surface 724 of the housing 710 force the flapper 716 to bow against its otherwise flat shape. Preferably, the flapper is manufactured from material, such as silicone, that permits its integrity to be maintained at temperatures of 400 degrees Fahrenheit. In some embodiments, the flapper valve housing 710 is made from aluminum. Preferably, a rubber o-ring is employed as a seal between the flapper valve housing 710 and the enclosure 110.

When a difference between an internal gas pressure of the internal gases residing inside of the enclosure 110 is less than or equal to an atmospheric pressure of said atmospheric gases residing outside of the enclosure 110, portions of the flapper 716 that are located outside of the center portion of the flapper 716 are configured to form a flat surface and as a result, press upward (not shown) to make physical contact with an outer rim 713 of the inlet port 712 and the inner surface 724, to fully obstruct any flow of internal gases through the inlet port 712 and through the flapper valve 700.

When a difference between the internal gas pressure of internal gases residing inside of the enclosure 110 is sufficiently greater than the atmospheric pressure of said atmospheric gases residing outside of the enclosure 110, portions of the flapper 716 that are located outside of the center portion of the flapper 716 that are in physical contact with the flapper support 718, are pushed by the internal gases in a direction towards and against the flapper support 718. As a result, a gap 720 is formed between the outer rim 713 of the inlet port 712 and the flapper 716. The gap 720 eliminates the full obstruction of the flow of internal gases through the inlet port 712, and enables the flow of internal gases around a gap 722 adjacent the outer edge of the flapper 716 and out through the one or more outlet ports 714 of the flapper 716.

In some embodiments, the difference is sufficiently greater by 0.25 pounds per square inch or less. In some embodiments, the difference is sufficiently greater by approximately 0.1 pounds per square inch. Optionally, grooves can be etched along the inner surface 724 of the housing 710 to enhance the flow of internal gases around the flapper 716.

This embodiment 700 of a flapper valve can also be implemented as an air input valve 140 where the direction of the flow of gas, being air, is directed into instead of out of the enclosure 110. Various known embodiments of a flapper type of valve, or other types of pressure sensitive one way valves, can be manufactured or purchased off the shelf and employed to implement the air input port 140 and/or the gas output port 150 valves.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A tobacco smoking apparatus, including:

an enclosure that is configured for enclosing tobacco combustion activity and that includes one or more filters;

an inhale/exhale conduit that is configured to enable a person to inhale substances accessible from said tobacco combustion activity;

a tobacco input port that is configured for inputting tobacco into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases and other combustion products residing inside of said enclosure when an internal gas pressure of said internal gases residing inside said enclosure is greater than said atmospheric pressure by a sufficient positive pressure value; and where said one or more filters are configured for filtering of undesirable combustion products that are mixed with internal gases that are output from said enclosure.

2. The apparatus of claim 1 where said sufficient negative pressure value is approximately 0.1 pounds per square inch.

3. The apparatus of claim 1 where said sufficient positive pressure value is approximately 0.1 pounds per square inch.

4. The apparatus of claim 1 where said sufficient negative pressure value is less than or equal to 0.25 pounds per square inch.

5. The apparatus of claim 1 where said sufficient positive pressure value is less than or equal to 0.25 pounds per square inch.

6. The apparatus of claim 1 where said enclosure includes at least a HEPA filter.

7. The apparatus of claim 1 where said enclosure includes at least a charcoal filter.

8. The apparatus of claim 1 where said enclosure includes at least a white filter media filter.

9. The apparatus of claim 1 where said enclosure has a top surface and a bottom surface and where said top surface surrounds said inhale/exhale conduit and said bottom surface surrounds said gas output port.

10. The apparatus of claim 1 where said enclosure has a top surface and a bottom surface and where said bottom surface surrounds said gas output port.

11. A method for smoking tobacco, including the steps of:

providing an apparatus including an enclosure that is configured for enclosing tobacco combustion activity and that includes one or more filters, and including an inhale/exhale conduit that is configured to enable a person to inhale substances accessible from said tobacco combustion activity, and including a tobacco input port that is configured for inputting tobacco into said enclosure, and including an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and including a gas output port that is configured to output internal gases and other combustion products residing inside of said enclosure when an internal gas pressure of said internal gases residing inside said enclosure is greater than said atmospheric pressure by a sufficient positive pressure value; and where said one or more filters are configured for filtering of undesirable combustion products that are mixed with internal gases that are output from said enclosure; and inhaling tobacco combustion products via said inhale/exhale conduit.

12. A tobacco smoking apparatus comprising:

an enclosure that is configured for enclosing tobacco combustion activity, said enclosure having a top and a bottom;

wherein said tobacco smoking apparatus is configured so that a user can both inhale combustion products from said enclosure and exhale combustion products into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases residing inside of said enclosure when an internal gas pressure of said internal gases residing inside said enclosure is greater than said atmospheric pressure of said atmospheric gases residing outside of said enclosure by a sufficient positive pressure value;

wherein said gas output port is located at said bottom;

wherein said tobacco smoking apparatus is configured to hold tobacco at a position above said gas output port and wherein said tobacco smoking apparatus is configured so that when a user exhales said combustion products, said internal gases exit said enclosure through said gas output port.

13. The tobacco smoking apparatus of claim 12, wherein at least one filter is disposed above said gas output port and below said position at which said tobacco can be held.

14. The tobacco smoking apparatus of claim 12, wherein said bottom includes a substantially flat bottom surface, and wherein said substantially flat bottom surface is adjacent to said gas output port.

15. A tobacco smoking apparatus comprising:

an enclosure that is configured for enclosing tobacco combustion activity;

wherein said tobacco smoking apparatus is configured so that a user can both inhale combustion products from said enclosure and exhale combustion products into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases residing inside of said enclosure when an internal gas pressure of said internal gases residing inside said enclosure is greater than said atmospheric pressure of said atmospheric gases residing outside of said enclosure by a sufficient positive pressure value;

wherein said tobacco smoking apparatus includes a series of filters for filtering of combustion products that are mixed with internal gases that are output from said enclosure, said series of filters including, in series, a high efficiency particulate arrestant filter and a carbon filter.

16. The tobacco smoking apparatus of claim 15, wherein said series of filters are disposed in a vertical orientation with respect to one another within said enclosure.

17. The tobacco smoking apparatus of claim 15, wherein said series of filters are disposed at an elevation that is below said air input port and above said gas output port.

18. The tobacco smoking apparatus of claim 15, wherein said series of filters are disposed at an elevation that is below said air input port and above said gas output port, and wherein said high efficiency particulate arrestant filter is disposed above said carbon filter.

19. The tobacco smoking apparatus of claim 15, wherein said series of filters further includes tightly woven cotton or cotton like material.

20. A tobacco smoking apparatus, including:

an enclosure that is configured for enclosing tobacco combustion activity and that includes one or more filters;

wherein said tobacco smoking apparatus is configured so that a user can both inhale combustion products from said enclosure and exhale combustion products into said enclosure;

a tobacco input port that is configured for inputting tobacco into said enclosure;

an air input port, said tobacco smoking apparatus being configured so that atmospheric gases are drawn into said enclosure through said air input port in response to said user inhaling; and a gas output port, said tobacco smoking apparatus being configured so that internal gases of said enclosure are output from said gas output port in response to said user exhaling;

wherein said one or more filters are configured for filtering of undesirable combustion products that are mixed with internal gases that are output from said enclosure.

21. The tobacco smoking apparatus of claim 20, wherein said tobacco smoking apparatus includes a port for use in inhaling, and wherein said tobacco smoking apparatus is configured so that a user can exhale said combustion products through said port for use in inhaling.

22. The tobacco smoking apparatus of claim 20, wherein said enclosure has a top and a bottom, and wherein said gas output port is disposed at said bottom of said enclosure.

23. The tobacco smoking apparatus of claim 20, wherein said tobacco smoking apparatus includes a port for use in inhaling, and wherein said enclosure includes a top and a bottom, wherein said gas output port is disposed at said bottom and wherein said one or more filters is provided by a series of filters comprising a charcoal filter and a high efficiency particulate arrestant filter disposed above said gas output port and below each of said air input port and said port for use in inhaling.

24. A tobacco smoking apparatus, including:

an enclosure that is configured for enclosing tobacco combustion activity having disposed therein a series of filters including a charcoal filter and a high efficiency particulate arrestant filter, the enclosure having a top portion and a portion below said top portion;

wherein said tobacco smoking apparatus is configured so that a user can both inhale combustion products from said enclosure and exhale combustion products into said enclosure;

a combustion cavity partially delimited by said series of filters and partially delimited by said top portion of said enclosure, said tobacco smoking apparatus being configured so that tobacco can be disposed in said combustion cavity;

an air input port, said tobacco smoking apparatus being configured so that atmospheric gases are drawn into said enclosure through said air input port in response to said user inhaling;

a port for use in inhaling through which substances within said enclosure are drawn in response to said user inhaling; and a gas output port, said tobacco smoking apparatus being configured so that internal gases of said enclosure are output from said gas output port in response to said user exhaling;

wherein said series of filters are configured for filtering of undesirable combustion products that are mixed with internal gases that are output from said enclosure.

25. The tobacco smoking apparatus of claim 24, wherein said gas output port is disposed below said series of filters.

26. The tobacco smoking apparatus of claim 24, wherein each of said air input port and said port for use in inhaling are disposed at said top portion of said enclosure.

27. The tobacco smoking apparatus of claim 24, wherein said top portion of said enclosure is formed of stainless steel and wherein said portion below said top portion is formed of a material other than stainless steel.

28. A tobacco smoking apparatus for use in smoking a cigarette, including:

an enclosure that is configured for enclosing tobacco combustion activity and that includes one or more filters;

an inhale/exhale conduit that is configured to enable a person to inhale substances accessible from said tobacco combustion activity;

a tobacco input port that is configured for inputting tobacco into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases and other combustion products residing inside of said enclosure when an internal gas pressure of said internal gases residing inside said enclosure is greater than said atmospheric pressure by a sufficient positive pressure value; and wherein said one or more filters are configured for filtering of undesirable combustion products that are mixed with internal gases that are output from said enclosure;

wherein the apparatus is configured for combustion of a cigarette.

29. The tobacco smoking apparatus of claim 28, wherein said tobacco smoking apparatus includes a cigarette loading port.

30. The tobacco smoking apparatus of claim 28, wherein said tobacco smoking apparatus includes a cigarette holder.

31. The tobacco smoking apparatus of claim 29, wherein said air input port is located proximate to and oriented in series with said cigarette loading port.

32. The tobacco smoking apparatus of claim 29, wherein said air input port has a sealed and unsealed position and wherein said air input port encloses said cigarette loading port when said air input port is in said sealed position.

33. The tobacco smoking apparatus of claim 28, wherein said enclosure has a side surface and wherein said side surface encloses a tobacco loading port for use in loading a cigarette.

34. The tobacco smoking apparatus of claim 28, wherein said enclosure has a side surface and wherein said side surface encloses a rod port, and wherein said tobacco smoking apparatus further includes a rod, disposed within said rod port for use in manually moving said cigarette between various positions within said enclosure.

35. A tobacco smoking apparatus for use in smoking a cigarette, said tobacco smoking apparatus comprising:

an enclosure that is configured for enclosing tobacco combustion activity;

wherein said tobacco smoking apparatus is configured so that a user can both inhale combustion products from said enclosure and exhale combustion products into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases and other combustion products residing inside of said enclosure when an internal gas pressure of said internal gases residing inside said enclosure is greater than said atmospheric pressure by a sufficient positive pressure value;

wherein said tobacco smoking apparatus includes a movable cigarette holder for holding a cigarette, said tobacco smoking apparatus being configured so that a user of said tobacco smoking apparatus can manually move said moveable cigarette holder between a first position and a second position, wherein said cigarette holder when in said first position holds said cigarette so that a front end of said cigarette extends to a position external to said enclosure, wherein said cigarette holder when in said second position holds said cigarette so that said cigarette is entirely enclosed within said enclosure.

36. The tobacco smoking apparatus of claim 35, wherein said enclosure has a top and a bottom, and wherein said tobacco smoking apparatus is configured so that said movable cigarette holder holds a cigarette horizontally within said enclosure.

37. The tobacco smoking apparatus of claim 35, wherein said enclosure includes a port for use in inhaling combustion products, said tobacco smoking apparatus being configured so that when said movable cigarette holder is in said second position, a back end of said cigarette is closer to said port for use in inhaling than when in said first position.

38. The tobacco smoking apparatus of claim 35, wherein said tobacco smoking apparatus includes a tubular structure extending from said movable cigars holder for directing combustion products from said movable cigarette holder toward said port for use in inhaling.

39. The tobacco smoking apparatus of claim 35, wherein said movable cigarette holder is configured to be slid between said first position and said second position.

40. The tobacco smoking apparatus of claim 35, wherein said air input port has an outside portion that is pivotable between an open position and a closed position.

41. The tobacco smoking apparatus of claim 35, wherein said tobacco smoking apparatus is configured so that said atmospheric gases are input through said air input port responsively to said user inhaling said combustion products.

42. The tobacco smoking apparatus of claim 35, wherein said tobacco smoking apparatus is configured so that said internal gases are output from said enclosure responsively to said user exhaling said combustion products.

43. The tobacco smoking apparatus of claim 35, wherein said tobacco smoking apparatus includes a rod that can extend to an exterior of said enclosure, the smoking apparatus being configured so that said user can move said movable cigarette holder by pulling or pushing said rod.

44. The tobacco smoking apparatus of claim 35, wherein said movable cigarette holder is sized to hold said cigarette via a "snug fit" type of engagement.

45. The tobacco smoking apparatus of claim 35, wherein said movable cigarette holder is configured so that said cigarette can be held by said movable cigarette holder by way of a user pressing said cigarette into said movable cigarette holder.

46. A tobacco smoking apparatus for use in smoking a cigarette, said tobacco smoking apparatus comprising:

an enclosure that is configured for enclosing tobacco combustion activity;

wherein said tobacco smoking apparatus is configured so that a user can both inhale combustion products from said enclosure and exhale combustion products into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases residing inside of said enclosure when an internal gas pressure of said internal gases residing inside said enclosure is greater than said atmospheric pressure of said atmospheric gases residing outside of said enclosure by a sufficient positive pressure value; and wherein said tobacco smoking apparatus includes a port for use in inhaling combustion products, wherein said tobacco smoking apparatus includes a cigarette holder for holding a cigarette within said enclosure, and wherein said tobacco smoking apparatus includes a tubular structure for directing combustion products from said cigarette holder toward said port when said user inhales said combustion products, said tobacco smoking apparatus further being configured so that when a user exhales said combustion products into said enclosure, internal gases are output from said gas output port.

47. The tobacco smoking apparatus of claim 46, wherein said tubular structure is a hollow rod attached to said cigarette holder.

48. A tobacco smoking apparatus for use in smoking a cigarette, said tobacco smoking apparatus comprising:

an enclosure that is configured for enclosing tobacco combustion activity;

wherein said tobacco smoking apparatus is configured so that a user can both inhale combustion products from said enclosure and exhale combustion products into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases residing inside of said enclosure when an internal gas pressure of said internal gases residing inside said enclosure is greater than said atmospheric pressure of said atmospheric gases residing outside of said enclosure by a sufficient positive pressure value; and wherein said tobacco smoking apparatus includes a port for use in inhaling combustion products, wherein said tobacco smoking apparatus is configured to hold a cigarette entirely within said enclosure, and wherein said tobacco smoking apparatus is configured so that when a user inhales said combustion products, said combustion products are drawn through said cigarette, said tobacco smoking apparatus further being configured so that when a user exhales said combustion products into said enclosure internal gases are output from said gas output port.

49. The tobacco smoking apparatus of claim 48, wherein said tobacco smoking apparatus includes an inhale/exhale port through which said combustion products are output when said user inhales, and through which said combustion products are input when said user exhales.

50. A tobacco smoking apparatus for use in smoking a cigarette, said tobacco smoking apparatus comprising:

an enclosure that is configured for enclosing tobacco combustion activity, wherein said tobacco smoking apparatus includes a holder that holds said cigarette entirely within said enclosure during smoking of said cigarette, said enclosure having a top and a bottom;

wherein said tobacco smoking apparatus is configured so that a user can both inhale combustion products from said enclosure and exhale combustion products into said enclosure;

an air input port, said tobacco smoking apparatus being configured so that atmospheric gases are drawn in through said air input port and through said cigarette in response to said user inhaling;

a gas output port, said tobacco smoking apparatus being configured so that internal gases of said enclosure are output from said gas output port in response to said user exhaling; and one or more filters configured for filtering of undesirable combustion products that are mixed with internal gases that are output from said enclosure;

wherein said gas output port is disposed at said bottom below said holder, and wherein said one or more filters are disposed intermediate of said holder and said gas output port.

51. The tobacco smoking apparatus of claim 50, wherein said bottom includes a bottom surface and wherein said gas output port is adjacent to said bottom surface.

52. The tobacco smoking apparatus of claim 50, wherein said smoking apparatus includes a port for use in inhaling through which said combustion products are inhaled when said user inhales said combustion products.

53. The tobacco smoking apparatus of claim 50, wherein said port for use in inhaling is located at said bottom.

54. A tobacco smoking apparatus for use in smoking a cigarette, including:

an enclosure that is configured for enclosing tobacco combustion activity and that includes one or more filters for filtering undesirable combustion products;

wherein said tobacco smoking apparatus is configured so that a user can both inhale combustion products from said enclosure and exhale combustion products into said enclosure;

a tobacco input port that is configured for inputting tobacco into said enclosure;

an air input port, said smoking apparatus being configured so that atmospheric gases are drawn in through said air input port and through said cigarette in response to said user inhaling;

a gas output port, said smoking apparatus being configured so that internal gases of said enclosure are output from said gas output port in response to said user exhaling;

a port for use in inhaling through which said combustion products are output when said user inhales said combustion products; and a holder that holds said cigarette at a predetermined position within said enclosure;

wherein said port for use in inhaling and said holder are arranged so that when said cigarette is held at said predetermined position, a back end of said cigarette is underneath and substantially aligned with said port for use in inhaling.

55. The tobacco smoking apparatus of claim 54, wherein said holder is configured to hold said cigarette via a "snug fit" type of engagement.

56. The tobacco smoking apparatus of claim 54, wherein said holder is configured so that said cigarette can be held by said holder by way of a user pressing said cigarette into said holder.

57. The tobacco smoking apparatus of claim 54, wherein said smoking apparatus is configured so that said holder is manually movable by said user between a first position and a second position, a front end of said cigarette extending to an exterior of said enclosure when said holder is at said first position, said cigarette being entirely enclosed within said enclosure at said predetermined position when said holder is at said second position.

58. A tobacco smoking apparatus for use in smoking a cigarette, said tobacco smoking apparatus including:

an enclosure that is configured for enclosing tobacco combustion activity and that includes one or more filters;

wherein said tobacco smoking apparatus is configured so that a user can both inhale combustion products from said enclosure and exhale combustion products into said enclosure;

a tobacco input port that is configured for inputting tobacco into said enclosure;

an air input port having an associated air input valve, said tobacco smoking apparatus being configured so that atmospheric gases are drawn in through said air input port and through said cigarette in response to said user inhaling; and a gas output port having an associated gas output valve, said tobacco smoking apparatus being configured so that internal gases of said enclosure are output from said gas output port in response to said user exhaling;

wherein said one or more filters are configured for filtering of undesirable combustion products that are mixed with internal gases that are output from said enclosure;

wherein said tobacco smoking apparatus is configured so that when said user inhales said combustion products, said air input valve is open and said gas output valve is closed;

wherein said smoking apparatus is further configured so that when said user exhales said combustion products, said air input valve is closed and said gas output valve is open.

59. The tobacco smoking apparatus of claim 58, wherein said gas output valve includes a flapper manufactured to have a flat and circular shape when not influenced by outside forces.

60. The tobacco smoking apparatus of claim 58, wherein said gas output valve is a pressure sensitive one way valve.

61. A tobacco smoking apparatus for use in smoking loose tobacco, including:

an enclosure that is configured for enclosing tobacco combustion activity and that includes one or more filters;

an inhale/exhale conduit that is configured to enable a person to inhale substances accessible from said tobacco combustion activity;

a tobacco input port that is configured for inputting tobacco into said enclosure;

an air input port that is configured to input atmospheric gases residing outside of said enclosure when an internal gas pressure of internal gases residing inside of said enclosure is less than an atmospheric pressure of said atmospheric gases residing outside of said enclosure by a sufficient negative pressure value; and a gas output port that is configured to output internal gases and other combustion products residing inside of said enclosure when an internal gas pressure of said internal gases residing inside said enclosure is greater than said atmospheric pressure by a sufficient positive pressure value;

wherein said one or more filters are configured for filtering of undesirable combustion products that are mixed with internal gases that are output from said enclosure;

wherein the apparatus is configured for combustion of loose tobacco.

62. The tobacco smoking apparatus of claim 61, where said smoking apparatus includes a tobacco loading port configured to allow for loading of loose tobacco, where enclosure has a top surface and a bottom surface and where said top surface surrounds said tobacco loading port and said bottom surface surrounds said gas output port.

63. A tobacco smoking apparatus for use in smoking loose tobacco, said tobacco smoking apparatus comprising:

an enclosure that is configured for enclosing tobacco combustion activity, wherein said tobacco smoking apparatus includes a loose tobacco bowl for holding loose tobacco, said loose tobacco bowl being constructed from meshed metal screen, said enclosure having a top and a bottom;

wherein said tobacco smoking apparatus is configured so that a user can both inhale combustion products from said enclosure and exhale combustion products into said enclosure;

wherein said smoking apparatus is configured so that loose tobacco can be input into said enclosure;

an air input port, said tobacco smoking apparatus being configured so that atmospheric gases are drawn in through said air input port in response to said user inhaling;

a gas output port, said tobacco smoking apparatus being configured so that internal gases of said enclosure are output from said gas output port in response to said user exhaling; and one or more filters disposed below said loose tobacco bowl and above said gas output port configured for filtering of undesirable combustion products that are mixed with internal gases that are output from said enclosure;

wherein said gas output port is disposed at said bottom below said holder, and wherein said one or more filters are disposed intermediate of said holder and said gas output port.

64. The tobacco smoking apparatus of claim 63, wherein said bottom includes a bottom surface and wherein said gas output port is adjacent to said bottom surface.

65. The tobacco smoking apparatus of claim 63, wherein said tobacco smoking apparatus includes a port for use in inhaling through which said combustion products are inhaled when said user inhales said combustion products.

66. The tobacco smoking apparatus of claim 65, wherein said port for use in inhaling and said air input port are each located at said top above said one or more filters.

67. The tobacco smoking apparatus of claim 63, wherein said air input port includes an open position and a sealed position.

68. A tobacco smoking apparatus for use in smoking loose tobacco, including:

an enclosure that is configured for enclosing tobacco combustion activity and that includes one or more filters;

a loose tobacco bowl for holding loose tobacco, said loose tobacco bowl being constructed from meshed metal screen;

wherein said tobacco smoking apparatus is configured so that a user can both inhale combustion products from said enclosure and exhale combustion products into said enclosure;

wherein said tobacco smoking apparatus is configured so that loose tobacco can be input into said enclosure;

an air input port, said tobacco smoking apparatus being configured so that atmospheric gases are drawn in through said air input port in response to said user inhaling;

a port for use in inhaling, through which substances in said enclosure are drawn through in response to said user inhaling; and a gas output port, said tobacco smoking apparatus being configured so that internal gases of said enclosure are output from said gas output port in response to said user exhaling;

wherein said one or more filters are configured for filtering of undesirable combustion products that are mixed with internal gases that are output from said enclosure.

69. The tobacco smoking apparatus of claim 68, wherein said air input port includes an open position and a sealed position.

70. The tobacco smoking apparatus of claim 68, wherein said enclosure includes a top surface and wherein each of said air input port and said port for use in inhaling are disposed adjacent to said top surface.

71. A tobacco smoking apparatus for use in smoking loose tobacco, said tobacco smoking apparatus including:

an enclosure that is configured for enclosing tobacco combustion activity having disposed therein a series of filters including a charcoal filter and a high efficiency particulate arrestant filter, said enclosure having a top portion and a lower portion below said top portion;

wherein said tobacco smoking apparatus is configured so that a user can both inhale combustion products from said enclosure and exhale combustion products into said enclosure;

a combustion cavity partially delimited by said series of filters and partially delimited by said top portion of said enclosure, said tobacco smoking apparatus being configured so that tobacco can be disposed in said combustion cavity;

a loose tobacco bowl for holding loose tobacco disposed within said cavity, said loose tobacco bowl being constructed from meshed metal screen;

an air input port, said tobacco smoking apparatus being configured so that atmospheric gases are drawn into said enclosure through said air input port in response to said user inhaling;

a port for use in inhaling through which substances within said enclosure are drawn in response to said user inhaling;

wherein each of said air input port and said port for use in inhaling are disposed at said top portion of said enclosure; and a gas output port disposed at said lower portion of said enclosure and below said series of filters, said tobacco smoking apparatus being configured so that internal gases of said enclosure are output from said gas output port in response to said user exhaling;

wherein said series of filters are configured for filtering of undesirable combustion products that are mixed with internal gases that are output from said enclosure.

72. The tobacco smoking apparatus of claim 71, wherein said tobacco smoking apparatus is configured so that said user can exhale substances into said enclosure into said port for use in inhaling.

* * * * *

UNITED STATES PATENT AND TRADEMARK OFFICE

CERTIFICATE OF CORRECTION

PATENT NO. : 7,735,494 B2
APPLICATION NO. : 11/367109
DATED : June 15, 2010
INVENTOR(S) : Christopher N. Bollinger et al.

It is certified that error appears in the above-identified patent and that said Letters Patent is hereby corrected as shown below:

On the Title Page:

In Item (54), please delete "TABACCO" and replace with --TOBACCO--.

In the Specifications:

In Col. 1, line 1, delete "TABACCO" and replace with --TOBACCO--.

In the Claims:

In Col. 12, Claim 38, line 62, please delete "cigars" and replace with --cigarette--.

Signed and Sealed this

Twenty-sixth Day of October, 2010

David J. Kappos

David J. Kappos
*Director of the United States Patent and Trademark Office*